United States Patent [19]

Christini et al.

[11] 4,288,216

[45] Sep. 8, 1981

[54] CALCINER WITH TAPERED REVERSE FEED SPIRAL

[75] Inventors: James N. Christini; Tai K. Kim, both of Towanda; Robert P. McClintic, Monroeton, all of Pa.

[73] Assignee: GTE Products Corporation, Stamford, Conn.

[21] Appl. No.: 143,236

[22] Filed: Apr. 24, 1980

[51] Int. Cl.[3] ..... F27B 6/08; F27D 3/00

[52] U.S. Cl. ..... 432/112; 34/135; 414/149; 414/197; 432/117; 432/118; 432/239

[58] Field of Search ..... 432/112, 117, 118, 239; 414/149, 197; 34/135, 136, 137

[56] References Cited

U.S. PATENT DOCUMENTS

| | | | |
|---|---|---|---|
| 1,656,924 | 1/1928 | Smith | 432/112 |
| 3,441,259 | 4/1969 | Heyer et al. | 432/118 |
| 4,010,081 | 3/1977 | Martt | 414/149 |

FOREIGN PATENT DOCUMENTS

| | | | |
|---|---|---|---|
| 5997 | of 1906 | United Kingdom | 432/118 |

*Primary Examiner*—John J. Camby

*Attorney, Agent, or Firm*—Thomas H. Buffton

[57] ABSTRACT

A calciner includes a rotatable cylindrical retort which is indirectly heated and has material receiving and material discharging ends. A reverse pitch tapered spiral is affixed internal of the material discharging end with the spiral tapering toward the material discharging end whereby uniformity of material discharge over 300 degrees of rotation is achieved and whereby uniformity of agitation and increased residence time are achieved.

10 Claims, 3 Drawing Figures

CALCINER WITH TAPERED REVERSE FEED SPIRAL

TECHNICAL FIELD

This invention relates to calciners and more particularly to an improved calciner cylindrical retort for increasing material retention time of a calciner.

CROSS REFERENCE TO OTHER APPLICATIONS

A concurrently filed application bearing Attorney's Docket No. 22,303 filed in the name of James N. Christini, Ser. No. 143,234 filed Apr. 24, 1980, and assigned to the Assignee of the present application includes material related to the present application.

BACKGROUND ART

Calciners and particularly indirectly-heated calciners are utilized for heat-treating and drying of materials at temperatures higher than those normally employed in steam-heating apparatus. For example, indirectly-heated calciners having a rotating cylindrical retort are frequently employed to reduce mineral oxides to low oxides, dry and remove sulfur from cobalt, copper and nickel powders, reduce metal oxides, and numerous other similar applications wherein relatively high temperatures are desirable.

In the known types of calciners employing a rotating cylindrical retort, it is a common practice to feed the material for processing into one end of the retort and collect the processed material from an opposite discharge end. Also, a series of flights attached to the inner surface of the rotatable retort or a "scraper" chain may be utilized to control the progress of the material as it is processed through the rotating cylindrical retort.

Although the above-mentioned flights and scraper "chains" are necessary to insure continued progress of the materials through the cylindrical retort, a problem exists in that it would be highly desirable to increase the retention time or the time during which the material being processed remains in the cylindrical retort. Such an increase in retention time obviously leads to a highly desirable increase in loading capacity and enhanced utilization of the apparatus.

One known technique for achieving the above-mentioned increase in material retention time is to introduce a dam or screen into the discharge end of the cylindrical retort. Thus, the contained materials must either reach a height sufficient to spill over the dam or be of a size small enough to pass through the screen. Unfortunately, it has been found that both dams and screens are undesirably accompanied by pluggage of the retort. Moreover, attempts to clear the undesired pluggage result in undesired and expensive shutdown time or, in the case of screens, replacement thereof due to perforations encountered in attempts to unplug the screen. In both cases efficiency and costs suffer.

DISCLOSURE OF THE INVENTION

In one aspect of the invention, a calciner has a rotatable cylindrical retort with material receiving and material discharge ends and a reverse pitch tapered spiral is affixed internal of the material discharge end of the cylindrical retort.

BEST MODE FOR CARRYING OUT THE INVENTION

Figure 1:
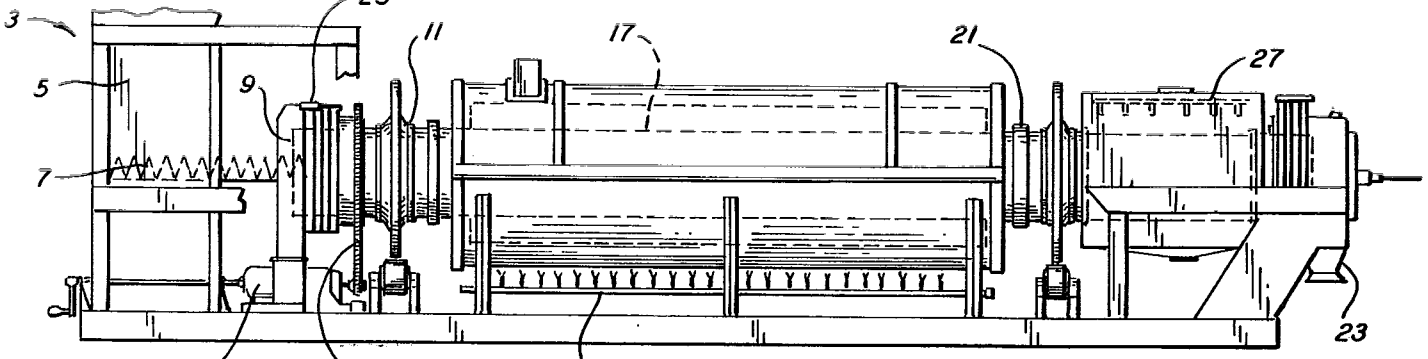
FIG. 1 is a diagrammatic illustration of a calciner having an indirectly-heated rotatable cylindrical retort.

For a better understanding of the present invention, together with other and further objects, advantages and capabilities of the invention, reference is made to the following disclosure and appended claims in conjunction with the accompanying drawings.

Referring to the drawings, a calciner 3 includes a material receiving bin 5 with a screw feed 7 connecting the receiving bin 5 to a material receiving end 9 of a cylindrical retort 11. A chain drive 13 is coupled to the cylindrical retort 11 and to a motor drive 15 which provides energy for rotating the cylindrical retort 11.

The cylindrical retort 11 has a "hot zone" 17 which, in this instance, is indirectly-heated by a plurality of burners 19. This "hot zone" 17 extends to a material discharge end 21 wherefrom the processed materials are exited through a discharge chute 23. Moreover, a first and second bellows arrangement 25 and 27 are located at the material receiving and discharge ends, 9 and 21 respectively, whereby atmospheric control internal of the cylindrical retort is maintained.

Figure 3:
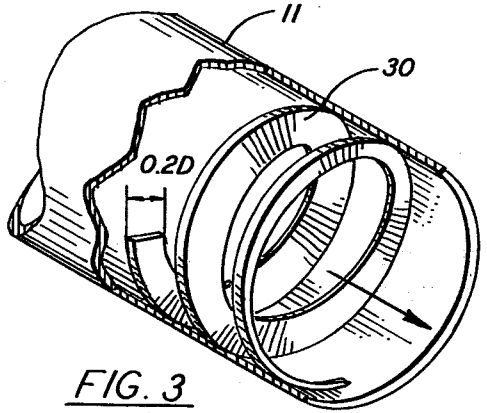
FIG. 3 is a perspective view of the tapered spiral of FIG. 2.
Figure 2:
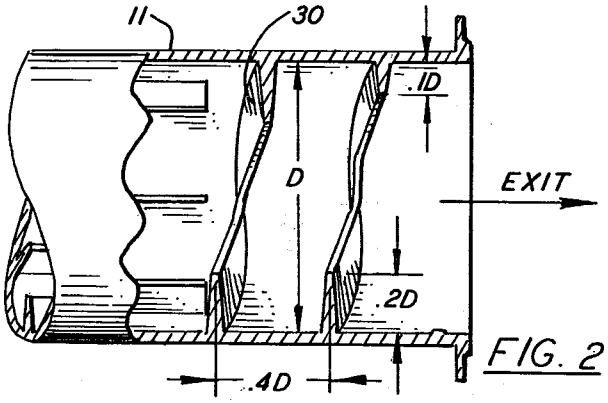
FIG. 2 is a sectional view of the cylindrical retort of the calciner of FIG. 1 including a preferred form of reverse pitch tapered spiral.

Referring to FIGS. 2 and 3, the cylindrical retort 11 has an internal diameter "D" wherein is affixed at the material discharge end 21 a two-turn reverse pitch tapered spiral 30. This reverse pitch tapered spiral 30, which may be either cast or welded internal of the retort 11, preferably has a height of about twenty percent (20%) of the internal diameter "D" on the turn most distant to the material discharge end 21. Thereafter, the second turn on turn nearest to the material discharge end 21 tapers at a substantially uniform rate from the above-mentioned twenty percent (20%) of the internal diameter "D" to about zero as the turn progresses toward the discharge end 21. Moreover, the pitch of the two-turn reverse pitch tapered spiral is preferably about forty percent (40%) of the internal diameter "D" of the cylindrical retort 11.

In one particular embodiment, which is in no way to be construed as limiting the invention, a calciner for reclaiming refractory material had a cylindrical retort of about eighteen (18) feed and an inner diameter "D" of about thirty (30) inches. Positioned internal of the material discharge end thereof is a two-turn reverse pitch tapered spiral wherein the turn most distant to the discharge end has a height of about six (6) inches and the turn closest to the discharge end tapers substantially uniformly from a maximum height of about six(6) inches to zero. Also, the two-turn reverse pitch tapered spiral has a pitch of about forty percent (40%) or in this case about twelve (12) inches.

As to operation, the calciner is continuously loaded at the material receiving end with material to be processed. The cylindrical retort 11 is rotated in a direction such that the reverse pitch tapered spiral tends to force the material back into the retort 11. The cylindrical retort 11 is heated from an external source during this rotation and the reverse pitch tapered spiral continuously feeds the material back into the heated retort. When the processed material exceeds the height of the reverse pitch tapered spiral, the processed material is expelled from the discharge end of the rotating cylindrical retort 11.

Testing of a calciner utilizing the above-described reverse pitch tapered spiral indicates a good agitation rate and residence time and, importantly, material exiting from the spiral during approximately 300- degrees of rotation. Moreover, the relatively low height of the spiral provides a processed material depth which is less than the level of the flights of the cylindrical retort whereby the above-mentioned good agitation is achieved.

While there has been shown and described what is at present considered the preferred embodiments of the invention, it will be obvious to those skilled in the art that various changes and modifications may be made therein without departing from the invention as defined by the appended claims.

INDUSTRIAL APPLICABILITY

In reclaiming metal scrap materials, such as refractory metals, wherein relatively high temperatures extending over relatively long processing times are required, the above-described calciner is especially suitable. Therein, the reverse pitch tapered spiral internal of the material discharge end of the rotating cylindrical retort tends to retain the processing material within the retort over a longer period whereby efficiency is increased and operational cost reduced.

We claim:

1. A reverse pitch tapered spiral for a refractory metal reclaiming calciner having a cylindrical rotatable retort of a given inner diameter with a material-receiving end and a material-discharging end separated by a hot zone and coupled to a motor drive for rotating the retort in a given direction to provide material flow in a given direction, said reverse pitch tapered spiral characterized by the improvement wherein a spiral having a reverse pitch with respect to said given direction of material flow is positionally located in said material-discharging end of said rotatable retort and tapers toward the material exit from said material-discharging end whereby the direction of material flow within said material discharge end is reversed with respect to material flow within said material-receiving end and hot zone of said rotatable retort.

2. The calciner of claim 1 wherein said reverse pitch tapered spiral is a two-turn reverse pitch tapered spiral.

3. The calciner of claim 1 wherein said reverse pitch tapered spiral has a maximum height of about twenty percent (20%) of the inside diameter of said cylindrical retort.

4. The calciner of claim 1 wherein said reverse pitch tapered spiral has a pitch of about forty percent (40%) of the inside diameter of said cylindrical retort.

5. The calciner of claim 1 wherein said reverse pitch tapered spiral tapers from a maximum to a minimum height in the direction of said material discharge end of said cylindrical retort.

6. The calciner of claim 1 wherein said reverse pitch tapered spiral is cast internal of said material discharge end of said cylindrical retort.

7. The calciner of claim 1 wherein said reverse pitch tapered spiral is welded internal of said material discharge end of said cylindrical retort.

8. In a refractory metal reclaiming calciner having a cylindrical rotatable retort of a given inner diameter with a material-receiving end and a material-discharging end separated by a hot zone and coupled to a motor dirve for rotating said retort in a given direction to provide material flow through said material-receiving end and hot zone in a given direction, a reverse pitch tapered spiral located in said material-discharging end of said rotatable retort and tapering toward the exit of said material discharging end, said reverse pitch tapered spiral characterized by the improvement wherein said material flow through said material-discharging end is reversed with respect to said material flow through said material-receiving end and said material exits said material-discharging end during a major portion of rotation of said retort.

9. The cylindrical retort of claim 8 wherein said reverse pitch tapered spiral is a two-turn reverse pitch tapered spiral tapering from a maximum to a minimum height toward said material discharge end of said cylindrical retort.

10. The cylindrical retort of claim 8 wherein said reverse pitch tapered spiral has a pitch of about forty percent (40%) of the inner diameter of said cylindrical retort.

* * * * *